US009243454B2

(12) United States Patent
Wenzel

(10) Patent No.: US 9,243,454 B2
(45) Date of Patent: Jan. 26, 2016

(54) APPARATUS FOR KEEPING A DOWNHOLE DRILLING TOOL VERTICALLY ALIGNED

(71) Applicant: Kenneth H. Wenzel, Edmonton (CA)

(72) Inventor: Kenneth H. Wenzel, Edmonton (CA)

( * ) Notice: Subject to any disclaimer, the term of this patent is extended or adjusted under 35 U.S.C. 154(b) by 582 days.

(21) Appl. No.: 13/673,378

(22) Filed: Nov. 9, 2012

(65) Prior Publication Data

US 2014/0131112 A1 May 15, 2014

(51) Int. Cl.
*E21B 7/06* (2006.01)
*E21B 7/10* (2006.01)
*E21B 17/10* (2006.01)

(52) U.S. Cl.
CPC ... *E21B 7/06* (2013.01); *E21B 7/10* (2013.01); *E21B 17/1014* (2013.01)

(58) Field of Classification Search
CPC ... E21B 17/1014; E21B 17/1078; E21B 7/06; E21B 7/10
See application file for complete search history.

(56) References Cited

U.S. PATENT DOCUMENTS

| | | | | |
|---|---|---|---|---|
| 3,637,032 A | | 1/1972 | Jeter | |
| 4,216,590 A | | 8/1980 | Kelly | |
| 4,241,796 A | * | 12/1980 | Green et al. | 175/24 |
| 4,930,586 A | | 6/1990 | Turin et al. | |
| 5,314,030 A | | 5/1994 | Peterson et al. | |
| 7,204,325 B2 | | 4/2007 | Song et al. | |
| 7,717,197 B2 | | 5/2010 | Wenzel | |

FOREIGN PATENT DOCUMENTS

GB 867025 5/1961

OTHER PUBLICATIONS

Product brochure for Vertical Drilling Systems, Baker Hughes Incorporated, Houston, Texas, US, 6 pages, 2004, On line: http://www.bakerhughesdirect.com/cgi/hello.cgi/INTEQ/Brochures/VertiTrak_brochure_2004.pdf.

Product Brochure for Power V, Schlumberger Marketing Communications, 5 pages, Mar. 2005, On line: http://www.slb.com/media/services/drilling/steerable/powerv.pdf.

* cited by examiner

*Primary Examiner* — Shane Bomar
*Assistant Examiner* — Steven MacDonald
(74) *Attorney, Agent, or Firm* — Davis & Bujold, P.L.L.C.; Michael J. Bujold

(57) ABSTRACT

An apparatus for keeping a down hole drilling tool vertically aligned has a tubular body having an axis, an inner bore, at least one perpendicular channel and at least one set of steering elements disposed on opposed sides of the tubular body and engaging the at least one perpendicular channel of the tubular body. The at least one perpendicular channel permits the steering elements to move perpendicularly to the axis of the tubular body and restricts movement parallel to the axis of the tubular body. The first and second steering elements are engaged such that movement of the first or second steering element toward an extended position relative to the tubular body moves the other steering element toward a retracted position relative to the tubular body. Actuators are carried by the tubular body that selectively actuate the steering elements toward the extended position to steer the down hole drilling tool.

13 Claims, 5 Drawing Sheets

APPARATUS FOR KEEPING A DOWNHOLE DRILLING TOOL VERTICALLY ALIGNED

FIELD

This relates to an apparatus for keeping a downhole drilling tool vertically aligned, and a drill string that uses the apparatus.

BACKGROUND

When drilling vertical well bores or vertical sections of wellbores, it is important to ensure the wellbores are properly aligned. U.S. Pat. No. 7,717,197 (Wenzel) entitled "Apparatus for Keeping a Downhole Drilling Tool Vertically Aligned" describes a tool that may be used to perform this function. This tool uses a number of steering elements that pivot out from the tubular body to reorient the drill bit when it begins to deviate from a vertical alignment.

SUMMARY

There is provided an apparatus for keeping a down hole drilling tool vertically aligned. The apparatus has a tubular body with an axis, an inner bore and at least one perpendicular channel. At least one set of first and second steering elements are disposed on opposed sides of the tubular body and engage the at least one perpendicular channel of the tubular body. The at least one perpendicular channel permits the first and second steering elements to move perpendicularly to the axis of the tubular body and restricts movement parallel to the axis of the tubular body. The first and second steering elements are engaged such that movement of the first or second steering element toward an extended position relative to the tubular body moves the other steering element toward a retracted position relative to the tubular body. Actuators are carried by the tubular body to selectively actuate the steering elements toward the extended position to steer the down hole drilling tool.

In another embodiment, the engagement section telescopically engages the corresponding steering element, such that the first and second steering elements are permitted to be in a retracted position simultaneously.

In another embodiment, the actuators have a piston chamber formed in the tubular body and a piston positioned within the piston chamber that engages the respective steering element when energized.

In another embodiment, the actuators are hydraulic actuators energized by pressurized fluid flowing through the inner bore of the tubular body. The tubular body has an inlet fluid passage for communicating the pressurized fluid into the piston chamber.

In another embodiment, spring elements are provided that apply a constant outward force to each piston to maintain contact between the pistons and the steering elements when the piston is not energized.

In another embodiment, each piston chamber includes an outlet passageway for relieving pressure in the piston chamber. The flow area of the outlet passageway is less than the flow area of the inlet fluid passage.

In another embodiment, the inlet fluid passages have inlets in communication with the inner bore of the tubular body. The inlets are disposed radially about the axis of the tubular body. Flow through the inlets is controlled by a valve that moves in response to the vertical orientation of the tubular body to control the flow of fluid through the fluid passageways and selectively actuate one or more steering elements to correct the vertical orientation of the tubular body.

In another embodiment, a plurality of sets of steering elements are provided. Each set of steering elements is spaced axially along the tubular body and move in a different radial direction relative to at least one other set of steering elements.

In another embodiment, the at least one perpendicular channel has a groove in the tubular body. The steering elements have elongate portions that engage the grooves.

In another embodiment, the elongate portions of the steering elements in a set of steering elements telescopically engage each other.

According to another aspect, there is provided a steering sub for a tubular body having an inner bore, an outer surface and at least one perpendicular channel, comprising at least one set of first and second steering elements disposed on opposed sides of the tubular body and engaging the at least one perpendicular channel of the tubular body. The at least one perpendicular channel permits the first and second steering elements to move perpendicularly to the axis of the tubular body and restricts movement parallel to the axis of the tubular body. The first and second steering elements are engaged such that movement of the first or second steering element toward an extended position relative to the tubular body moves the other steering element toward a retracted position relative to the tubular body. Actuators are carried by the tubular body that selectively actuate the steering elements.

In another embodiment, the engagement section telescopically engages the corresponding steering element, such that the first and second steering elements are permitted to be in a retracted position simultaneously.

In another embodiment, the at least one perpendicular channel comprises grooves in the tubular body, the steering elements comprising elongate portions that engage the grooves.

In another embodiment, the elongate portions of the steering elements in a set of steering elements telescopically engage each other.

In another embodiment, the elongate portions comprise interlocking protrusions having a first sloped surface on an inside of each protrusion and a second sloped surface on an outside of each protrusion, wherein the steering elements are assembled by pressing the protrusions together until the sloped surfaces slide along each other until the protrusions pass by each other.

In another embodiment, two or more sets of steering elements are spaced axially along the tubular body and spaced circumferentially about the circumference of the tubular body.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
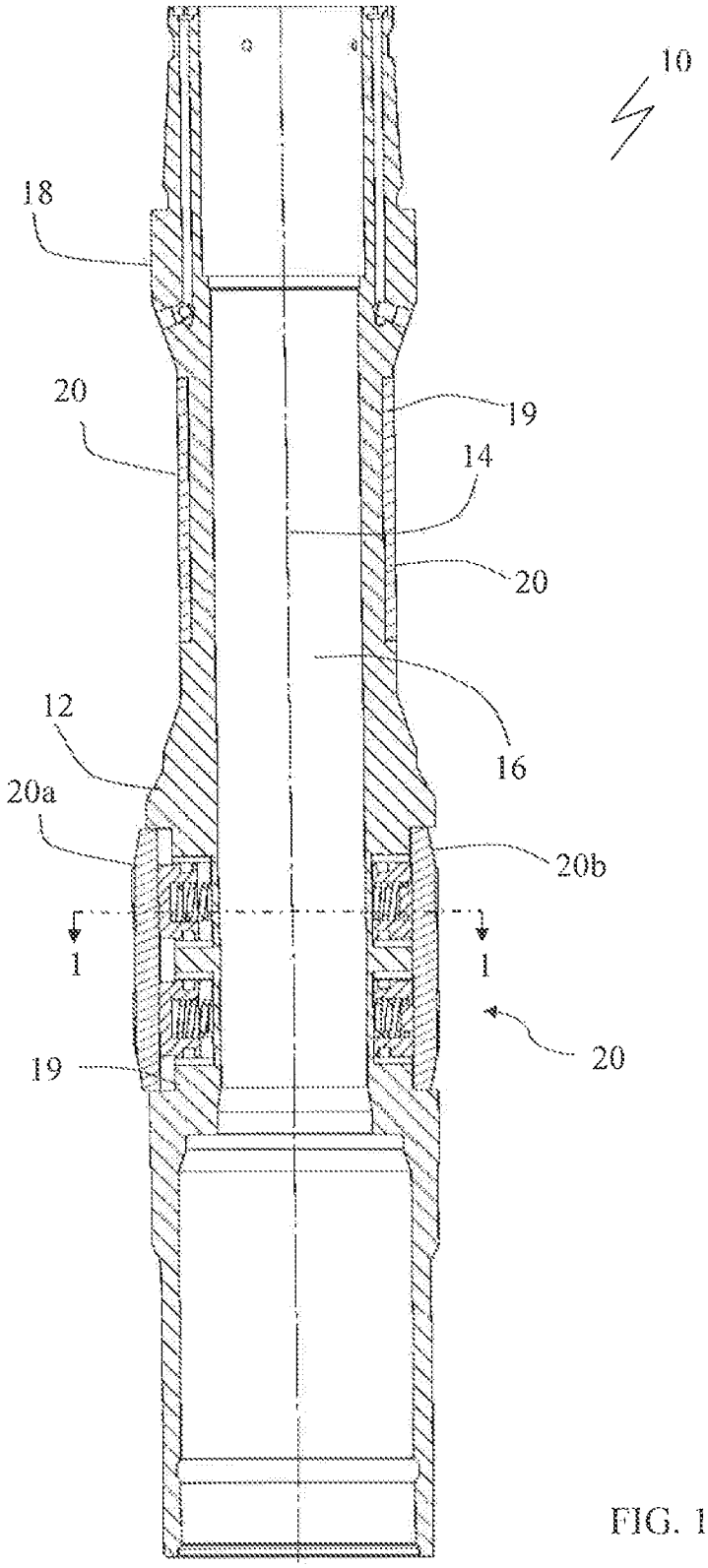
FIG. 1 is a side elevation view of an apparatus for keeping a downhole drilling tool vertically aligned.
Figure 3:
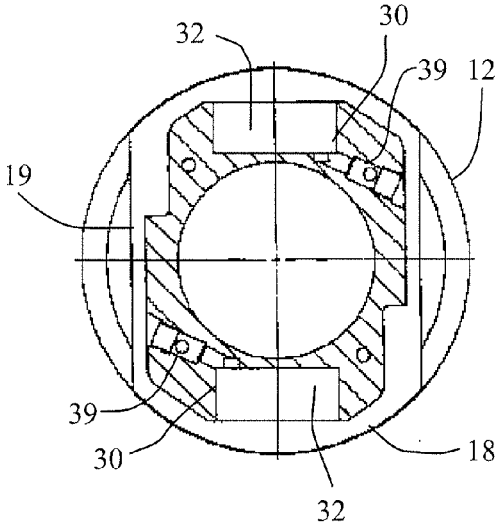
FIG. 3 is a sectional view along the line 2-2 of FIG. 2.
Figure 7:
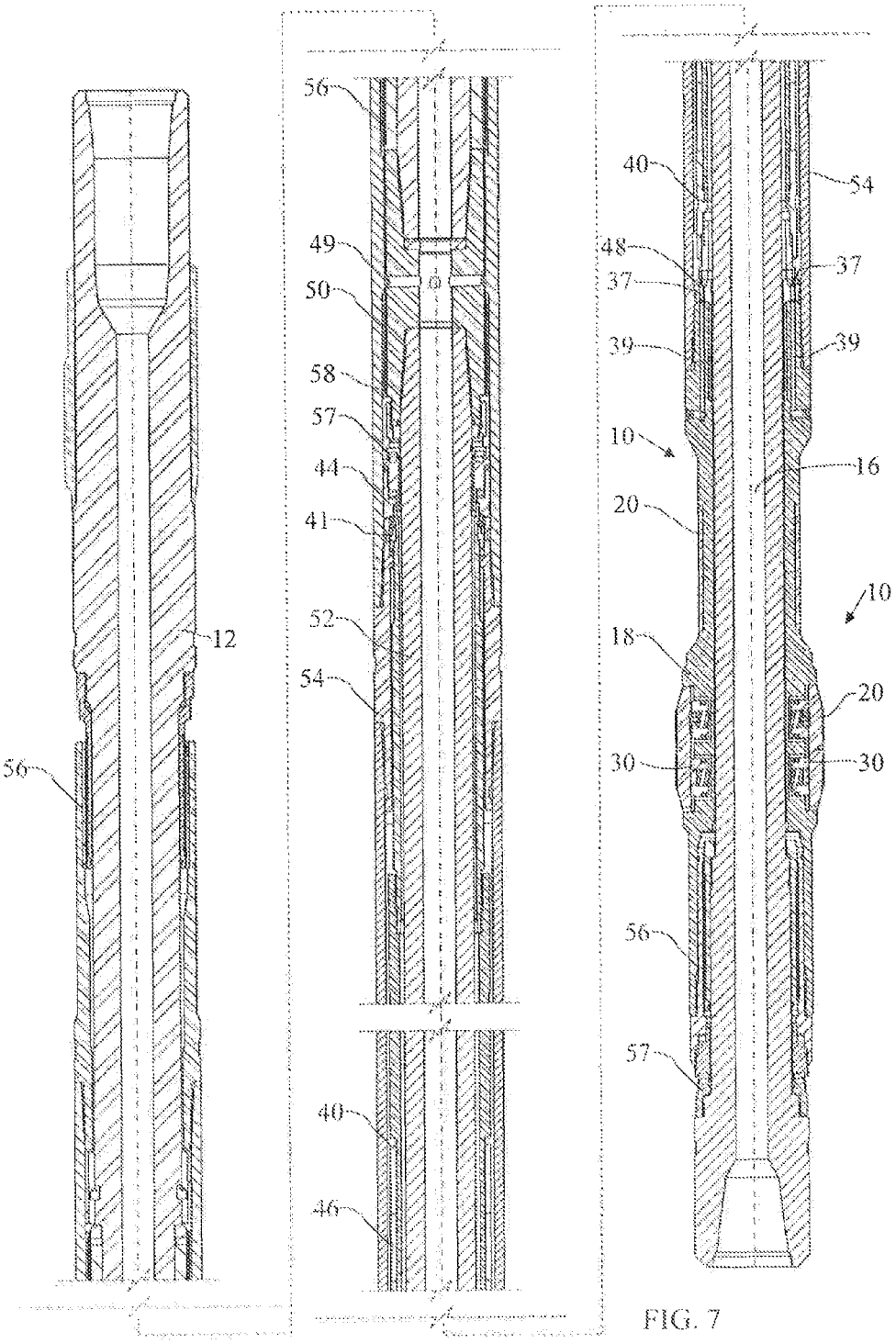
FIG. 7 is a side elevation view in section of a drill string that includes the apparatus shown in FIG. 1.

Referring to FIG. 1, an apparatus for keeping a down hole drilling tool vertically aligned is shown, and is generally indicated by reference numeral 10. Apparatus 10 includes a tubular body 12 having an axis represented by line 14, an inner bore 16 and a perpendicular channels 19. As shown in FIG. 7, tubular body 12 is attached as part of a drill string. Referring to FIG. 3, generally, outer surface 18 of tubular body 12 will have a circular cross-section except in areas where channels 19 are positioned. Referring to FIG. 1, channels 19 are used to receive and guide steering elements, sets of which are generally indicated by reference numeral 20. Each set 20 is shown as having a first steering element 20*a* and a second steering element 20*b*. First and second steering elements 20*a* and 20*b* are positioned on opposite sides of tubular body 12 relative to each other and engage channels 19.

Figure 2:
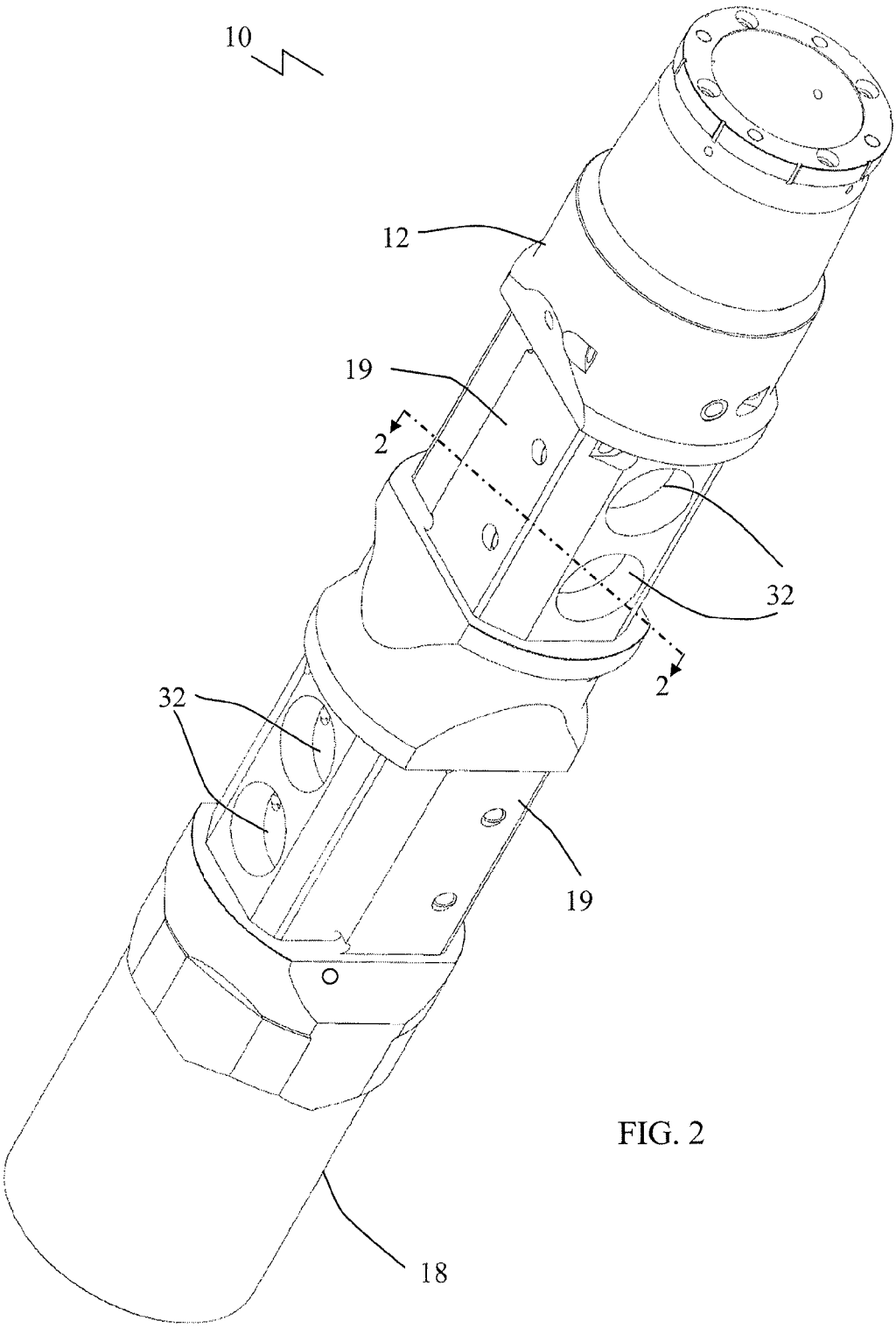
FIG. 2 is a perspective view of the apparatus shown in FIG. 1.
Figure 4:
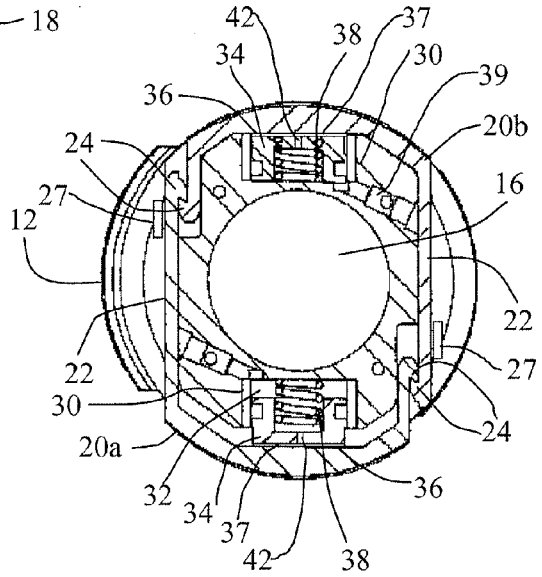
FIG. 4 is a sectional view along the line 1-1 of FIG. 1.

Referring to FIGS. 1 and 2, as shown, channels 19 are grooves in the outer surface of tubular body 12, and include flat, parallel surfaces on opposite sides of channels 19. Referring to FIG. 1, when engaged by steering elements 20, channels 19 prevent rotation and axial movement of steering elements 20. Recessed channels 19 are preferred as it allows steering elements 20 to be positioned within or flush with the outer surface of tubular body 12. Channels 19 permit steering elements 20 to move inward or outward from tubular body 12, perpendicular to the surface of tubular body 12, between an extended position and a retracted position. In the extended position, the respective steering element 20 is spaced above or outward from tubular body 12, while in the retracted position, steering element 20 is preferably flush with or retracted within the outer surface of tubular body 12. Referring to FIG. 4, steering elements 20*a* and 20*b* are engaged such that, as one steering element moves to the extended position, the corresponding steering element is pulled to the retracted position. Preferably, the connection between steering elements 20*a* and 20*b* is a telescopic element, such that both steering elements 20*a* and 20*b* are able to move to the retracted position at the same time. This is useful when tubular body 12 is being pulled out of a borehole to prevent unnecessary snags.

Figure 5:
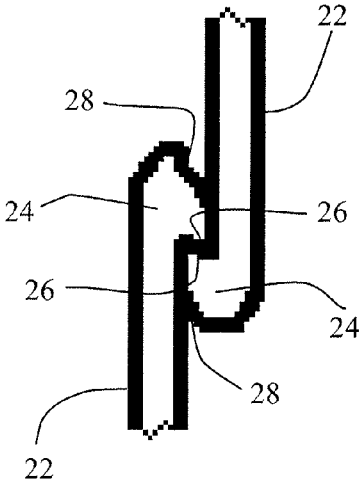
FIG. 5 is a detailed top elevation view of the side plate lip engagements.

In one example, steering elements 20*a* and 20*b* are connected by overlapping elongate portions, or side plates 22. Referring to FIG. 5, each side plate 22 includes a lip 24 that engages a corresponding lip 24 on the adjacent plate. As shown, lips 24 have a first sloped surface 26 on the inside of lip 24 and a second sloped surface 28 on the outside of lip 24. Steering elements 20*a* and 20*b* may be assembled by pressing them together until the sloped surfaces 28 slide along each other until lips 24 pass by each other. The resilience of the material steering elements 20*a* and 20*b* allows them to return to their original position, such that first sloped surfaces 26 keeps them together. In addition, referring to FIG. 4, a stop 27, such as the head of a bolt with a washer that overlaps the connection, may be installed as an additional measure to ensure separation does not occur. It has been found that this design is beneficial in that is relatively easy to manufacture and assembly. However, other designs may also be used that allow reciprocating movement that is perpendicular to tubular body 12 as described above.

There are preferably more than one set of steering elements 20 to allow for 360 degrees of control. For example, referring to FIG. 6, two sets of steering elements 20 are provided spaced axially along tubular body 12 and that are rotated such that they move in directions perpendicular to each other. When multiple sets of steering elements 20 are present, the relative angle between sets will depend on the preferences of the user and the number of steering elements 20. Preferably, the angles will be evenly spaced.

Referring now to FIG. 4, the movement of steering elements 20*a* and 20*b* are controlled by actuators 30 that are carried by tubular body 12. Actuators 30 selectively actuate each steering element 20*a* and 20*b* toward the extended position to steer tubular body 12 and therefore the downhole drilling tool it is part of.

Actuators 30 are preferably made up of a piston chamber 32 formed in tubular body 12 and a piston 34 positioned within piston chamber 32 that engages the respective steering element 20*a* or 20*b* when energized. As shown, each steering element 20*a* and 20*b* is pushed by two pistons 34, although there could be only one piston 34, or three or more pistons 34. Pistons 34 may be energized by a common fluid passage 39 as shown, or each may have its own fluid passage 39. Pistons 34 preferably have a flat upper surface 36 that engages steering elements 20*a* and 20*b* and a spring element 38 that keeps pistons 34 engaged with steering elements 20*a* and 20*b*. Spring element 38 is not intended to be strong enough to have a significant impact on the movement of steering elements 20, i.e. the strength is much less than the pressure used to move pistons 34, but rather to maintain contact between pistons 34 and steering elements 20 when not energized. These design elements help reduce unnecessary wear and prevents pistons 34 from disengaging steering elements 20 thereby not permitting debris from coming between pistons 34 and steering elements 20.

Figure 6:
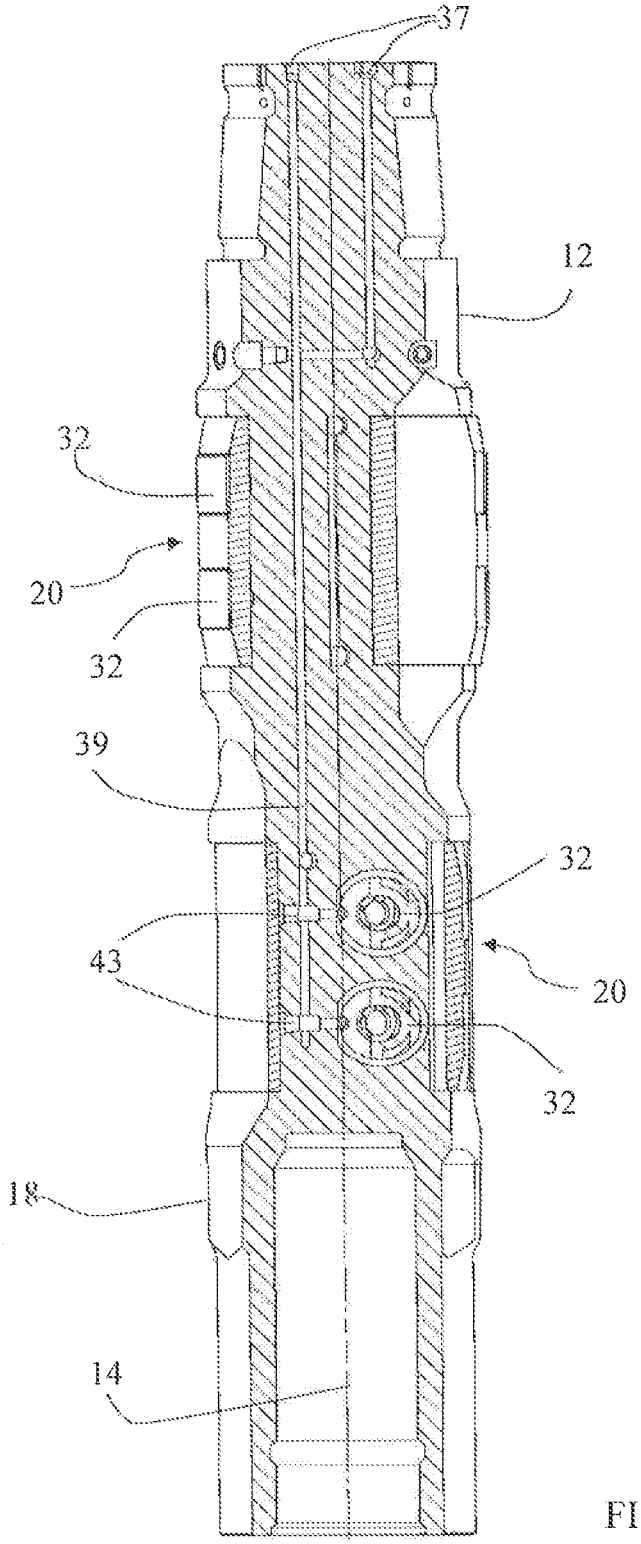
FIG. 6 is a side elevation view of the apparatus with two sets of steering elements.

Referring to FIGS. 6 and 7, actuators 30 are preferably hydraulic, as this permits them to be powered by the differential pressure present in the drilling fluid between the wellbore fluid pressure and the pressure in the fluid flowing through inner bore 16 of tubular body 12 due to the pressure drop across the drill bit. As shown, piston chambers 32 are connected to inner bore 16 by fluid passages 39. As shown, fluid passages 39 have inlet ports 37 that are open to inner bore 16 at a valve, in the form of a swinging pendulum 40, shown in FIG. 7, and ports 43 connected to piston chambers 32. Referring to FIG. 7, pendulum 40 is preferably fixed at an upper end 44 by an omnidirectional connection that permits it to swing in any direction within a space between inner and outer housings 52 and 54. In the depicted embodiment, pendulum 40 is carried within tubular body 12 by an O-ring 41 that permits limited movement to pendulum 40 as it deforms. O-ring 41 is preferably positioned between protective inserts, such as Teflon. While the movement may be limited, the length of pendulum 40 is sufficient to permit the necessary movement at the bottom of pendulum 40. to control inlet ports 37.

Pendulum 40 may carry weight collars 46 to increase the weight at the bottom of pendulum 40. At a lower end of pendulum 40, there is a closure member 48 that slides across inlet ports 37. Closure member 48 is preferably a carbide piece to reduce wear and erosion, and mounted telescopically at the bottom of pendulum 40 and moves across inlet ports 37. As tubular member 12 deviates from a vertical alignment, pendulum 40 will swing over to one side such that closure member 48 either opens or closes inlet ports 37 to control the flow of fluid. Inlet ports 37 are preferably disposed radially about the axis of tubular body 12, such that the movement of pendulum 40 opens or closes the appropriate inlet ports 37 that will result in the movement of the appropriate steering member 20.

Fluid pressure flows through inner bore 16 of tubular member 52, such as to a drill bit (not shown). An example of a fluid path that may be used will now be described. A portion of the fluid is redirected through a flow channel 49 into a space between an inner tubular member 52 and an outer tubular housing 54 toward inlet ports 37 at the bottom of pendulum 40. Between flow channel 49 and inlet ports 37, there is preferably a particle filter 50 above pendulum 40, or other means of controlling the size of particles entering inlet ports 37 to prevent clogging. Particle filter 50 is formed from two concentric cylindrical surfaces separated by a small gap, which determines the size of particles that are permitted to pass. As the surfaces move relative to each other, particle filter 50 also acts as a grinder to break down any particles to the permitted size prior to entering the system. The fluid then passes along the outside of pendulum 40 toward inlet ports 37. Other radial bearings 56 may be included to restrict fluid flow and align the tool and thrust bearings 57 to carry the axial load as will be recognized by those skilled in the art.

Referring to FIG. 6, inlet ports 37 may be normally open or normally closed when the tool is vertically aligned. If inlet ports 37 are normally open, actuators 30 on either side will be equally energized when tubular body 12 is in the vertical position such that steering elements 20 are in a neutral position. As pendulum 40 swings to one side to close a port, one actuator 30 will be de-energized, allowing the corresponding steering element 20*a* or 20*b* to be withdrawn while the other steering element 20*b* or 20*a* is extended and correcting the vertical orientation of tubular body 12. In the normally closed position, the movement of pendulum 40 permits the flow of fluid to energize the appropriate actuators 30 to correct the orientation of tubular body 12. The apparatus as described and depicted may be a sub or part of a sub that is threaded into a tubular body, such as a drill string, with first and second threaded couplings at the top and bottom.

Pendulum 40 is positioned between an inner tubular member 52 and an outer tubular housing 54. A drill bit is connected to inner tubular member 52, such that the majority of the weight is borne by inner tubular member 52. Steering elements 20 are carried by outer tubular housing 54.

Referring to FIG. 4, preferably, each piston chamber 32 also has an outlet passageway or a nozzle 42 as depicted, for relieving pressure. Preferably, outlet passageway 42 is open to the wellbore, which will be at a lower pressure than within the tubular member. As shown in FIG. 4, outlet passageway 42 is formed in piston 34, which preferably has grooves 37 in its face to allow fluid to drain into the space behind steering elements 20. As steering elements 20 are not sealed within channels 19, they are at the same pressure as in the wellbore. Outlet passageway 42 may be used to permit the fluid to be expelled even if the corresponding port 37 is closed. In order to allow piston chamber 32 to be properly energized, the flow area of outlet passageway 42 is less than the flow area of the inlet passageway. The flow out of piston chamber 32 is permitted due to the pressure drop across the drill bit, resulting in a lower pressure outside tubular 12. If the pressure differential across the drill bit is found to be insufficient, a nozzle can be added at the bottom of the drill string above the drill bit to increase it.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. An apparatus for keeping a down hole drilling tool vertically aligned, comprising:

a tubular body having an axis, an inner bore and at least one perpendicular channel;

at least one set of first and second steering elements disposed on opposed sides of the tubular body and engaging the at least one perpendicular channel of the tubular body, wherein:

the at least one perpendicular channel permits the first and second steering elements to move perpendicularly to the axis of the tubular body and restricts movement parallel to the axis of the tubular body;

the first and second steering elements are engaged such that movement of the first or second steering element toward an extended position relative to the tubular body moves the other steering element toward a retracted position relative to the tubular body; and actuators carried by the tubular body that selectively actuate the steering elements toward the extended position to steer the down hole drilling tool, and the actuators comprises a piston chamber formed in the tubular body and a piston positioned within the piston chamber that engages the respective steering element when energized.

2. The apparatus of claim 1, wherein the engagement between the first and the second steering elements is a sliding telescopic engagement such that the first and the second steering elements are permitted to be in the retracted position simultaneously.

3. The apparatus of claim 1, wherein the actuators are hydraulic actuators energized by pressurized fluid flowing through the inner bore of the tubular body, and the tubular body comprising an inlet fluid passage for communicating the pressurized fluid into the piston chamber.

4. The apparatus of claim 3, wherein each piston chamber further comprises an outlet passageway for relieving pressure in the piston chamber, the flow area of the outlet passageway being less than the flow area of the inlet fluid passage.

5. The apparatus of claim 3, wherein the inlet fluid passages comprise inlets in communication with the inner bore of the tubular body and disposed radially about the axis of the tubular body, and wherein flow through the inlets is controlled by a valve that moves in response to a vertical orientation of the tubular body to control the flow of fluid through the fluid passages and selectively actuate the one or more steering elements to correct the vertical orientation of the tubular body.

6. The apparatus of claim 1, further comprising spring elements that apply a constant outward force to each piston to maintain contact between the pistons and the steering elements when the piston is not energized.

7. The apparatus of claim 1, comprising a plurality of sets of steering elements, each set of steering elements being spaced axially along the tubular body and moving in a different radial direction relative to at least one other set of steering elements.

8. The apparatus of claim 1, wherein the at least one perpendicular channel comprises grooves in the tubular body, the steering elements comprising elongate portions that engage the grooves.

9. The apparatus of claim 8, wherein the elongate portions of the steering elements in a set of steering elements telescopically engage each other.

10. A steering sub for a tubular body having an inner bore, an outer surface and at least one perpendicular channel, the steering sub comprising:

at least one set of first and second steering elements disposed on opposed sides of the tubular body and engaging the at least one perpendicular channel of the tubular body, wherein:

the at least one perpendicular channel permits the first and second steering elements to move perpendicularly to the axis of the tubular body and restricts movement parallel to the axis of the tubular body;

the first and the second steering elements comprising elongate portions that are engaged such that movement of the first or the second steering element toward an extended position relative to the tubular body moves the other steering element toward a retracted position relative to the tubular body, and the elongate portions are slidably and telescopically engaged;

actuators carried by the tubular body that selectively actuate the steering elements;

the at least one perpendicular channel comprises grooves in the tubular body, and the steering elements comprise elongate portions that engage the grooves; and the elongate portions of the steering elements in a set of steering elements telescopically engage each other.

11. The steering sub of claim 10, wherein the elongate portions comprise interlocking protrusions having a first sloped surface on an inside of each protrusion and a second sloped surface on an outside of each protrusion, wherein the steering elements are assembled by pressing the protrusions together until the sloped surfaces slide along each other until the protrusions pass by each other.

12. The steering sub of claim 10, comprising two or more sets of steering elements spaced axially along the tubular body and spaced circumferentially about the circumference of the tubular body.

13. An apparatus for keeping a down hole drilling tool vertically aligned, comprising:

a tubular body having an axis, an inner bore and at least one perpendicular channel;

at least one set of first and second steering elements disposed on opposed sides of the tubular body and engaging the at least one perpendicular channel of the tubular body, wherein:

the at least one perpendicular channel permits the first and second steering elements to move perpendicularly to the axis of the tubular body and restricts movement parallel to the axis of the tubular body;

the first and second steering elements comprising elongate portions that are engaged such that movement of the first or second steering element toward an extended position relative to the tubular body moves the other steering element toward a retracted position relative to the tubular body, and the elongate portions being slidably and telescopically engaged; and actuators carried by the tubular body that selectively actuate the steering elements toward the extended position to steer the down hole drilling tool.

* * * * *